US010094176B2

(12) United States Patent
Reddy et al.

(10) Patent No.: US 10,094,176 B2
(45) **Date of Patent: *Oct. 9, 2018**

(54) SIDE SADDLE SUBSTRUCTURE

(71) Applicant: NABORS DRILLING USA, LP, Houston, TX (US)

(72) Inventors: Padira Reddy, Houston, TX (US); Ashish Gupta, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 190 days.

This patent is subject to a terminal disclaimer.

(21) Appl. No.: 15/191,094

(22) Filed: Jun. 23, 2016

(65) Prior Publication Data

US 2016/0369570 A1 Dec. 22, 2016

Related U.S. Application Data

(63) Continuation of application No. 14/180,049, filed on Feb. 13, 2014, now Pat. No. 9,810,027.

(60) Provisional application No. 61/764,259, filed on Feb. 13, 2013.

(51) Int. Cl.

| | |
|---|---|
| ***E21B 7/02*** | (2006.01) |
| ***E21B 15/00*** | (2006.01) |
| ***E21B 21/06*** | (2006.01) |
| ***E21B 21/10*** | (2006.01) |
| ***E21B 33/06*** | (2006.01) |

(52) U.S. Cl.

CPC ..... *E21B 15/003* (2013.01); *E21B 7/02* (2013.01); *E21B 21/065* (2013.01); *E21B 21/106* (2013.01); *E21B 33/06* (2013.01)

(58) Field of Classification Search

CPC . E21B 7/02; E21B 15/00; E21B 7/022; E04H 12/18

See application file for complete search history.

(56) References Cited

U.S. PATENT DOCUMENTS

| | | | |
|---|---|---|---|
| 1,733,484 | A | 10/1929 | Davis |
| 2,332,479 | A | 10/1943 | Woolslayer et al. |
| 2,345,253 | A | 3/1944 | Funk |
| 2,347,115 | A | 4/1944 | Lewis |

(Continued)

FOREIGN PATENT DOCUMENTS

| | | | |
|---|---|---|---|
| CA | 2755483 | A1 | 11/2010 |
| CA | 2753417 | A1 | 2/2011 |

(Continued)

OTHER PUBLICATIONS

Office Action issued in U.S. Appl. No. 15/191,140 dated Jul. 13, 2017 (12 pages).

(Continued)

*Primary Examiner* — Kenneth L Thompson
(74) *Attorney, Agent, or Firm* — Adolph Locklar

(57) ABSTRACT

The drilling rig includes a first substructure and a second substructure. The second substructure is positioned generally parallel to and spaced apart from the first substructure and generally the same height as the first substructure. The drilling rig further includes a drill floor coupled to the first and second substructures, where the drill floor positioned substantially at the top of the first and second substructures.

29 Claims, 2 Drawing Sheets

(56) References Cited

U.S. PATENT DOCUMENTS 2,594,847 A * 4/1952 Bates ..... E21B 15/00 173/151
3,028,881 A 4/1962 Koomey et al.
3,433,268 A 3/1969 Greer
3,483,933 A * 12/1969 Dyer ..... E21B 15/00 173/39
3,676,984 A 7/1972 Clark
3,716,149 A 2/1973 Scaggs
3,739,853 A 6/1973 Wales
3,802,137 A 4/1974 Armstrong
3,851,770 A 12/1974 Jenkins et al.
3,922,825 A 12/1975 Eddy et al.
3,942,593 A * 3/1976 Reeve, Jr. ..... E21B 7/023 173/151
4,021,978 A 5/1977 Busse et al.
RE29,541 E * 2/1978 Russell ..... E21B 3/02 175/52
4,117,941 A 10/1978 McCleskey et al.
4,221,088 A 9/1980 Patterson
4,235,566 A 11/1980 Beeman et al.
4,267,675 A 5/1981 Cochran
4,290,495 A 9/1981 Elliston
4,403,898 A 9/1983 Thompson
4,421,179 A 12/1983 Boyadjieff
4,474,254 A 10/1984 Etter et al.
4,478,015 A 10/1984 Lawrence et al.
4,478,291 A 10/1984 Futros
4,488,708 A * 12/1984 Frye ..... B66D 1/16 254/355
4,493,382 A * 1/1985 Collins ..... E21B 21/01 175/206
4,587,778 A 5/1986 Woolslayer et al.
4,757,592 A 7/1988 Reed
4,759,414 A 7/1988 Willis
4,823,870 A 4/1989 Sorokan
4,834,604 A 5/1989 Brittain et al.
4,850,439 A 7/1989 Lund
4,899,832 A 2/1990 Bierscheid, Jr.
4,979,578 A 12/1990 Landry
5,248,005 A * 9/1993 Mochizuki ..... E21B 7/023 166/901
5,305,833 A 4/1994 Collins
5,375,667 A 12/1994 Trevisani
5,492,436 A 2/1996 Suksumake
6,161,358 A * 12/2000 Mochizuki ..... E21B 15/00 405/201
6,491,477 B2 12/2002 Bennett, Jr. et al.
6,581,525 B2 * 6/2003 Smith ..... B62D 55/00 104/96
6,634,436 B1 10/2003 Desai
6,779,614 B2 8/2004 Oser
6,848,515 B2 2/2005 Off et al.
6,962,030 B2 11/2005 Conn
6,976,540 B2 12/2005 Berry
7,228,919 B2 6/2007 Fehres et al.
7,255,180 B2 8/2007 Beato et al.
7,306,055 B2 12/2007 Barnes
7,308,953 B2 12/2007 Barnes
7,308,963 B2 12/2007 Barnes
7,401,656 B2 7/2008 Wood et al.
7,404,697 B2 7/2008 Thompson
7,600,585 B2 10/2009 Patton et al.
7,628,229 B2 12/2009 Wood et al.
7,765,749 B2 * 8/2010 Palidis ..... E21B 15/00 173/184
7,819,207 B2 10/2010 Cowan
7,832,974 B2 11/2010 Fikowski et al.
7,878,254 B2 2/2011 Abdollahi et al.
7,931,076 B2 4/2011 Ditta et al.
7,967,540 B2 * 6/2011 Wright ..... E21B 19/155 166/377
7,992,646 B2 8/2011 Wright et al.
3,051,930 A1 11/2011 Barnes et al.
8,250,816 B2 8/2012 Donnally et al.
8,297,362 B1 10/2012 Strider et al.
8,316,588 B2 11/2012 Cicognani
8,468,753 B2 6/2013 Donnally et al.
8,474,216 B1 7/2013 Goerner
8,516,751 B2 8/2013 Konduc et al.
8,549,815 B2 10/2013 Donnally et al.
8,555,564 B2 * 10/2013 Wasterval ..... E21B 15/00 52/111
8,561,685 B2 * 10/2013 Rodgers ..... E21B 19/00 166/380
8,661,743 B2 3/2014 Flusche
8,720,128 B2 * 5/2014 Vogt ..... E21B 15/00 173/28
8,813,436 B2 8/2014 Donnally et al.
8,863,449 B2 10/2014 Donnally et al.
8,904,716 B2 12/2014 Donnally et al.
8,985,238 B2 3/2015 Sorokan et al.
8,985,928 B2 3/2015 Flusche
8,997,435 B2 4/2015 Reddy et al.
9,016,004 B2 4/2015 Vogt
9,027,287 B2 5/2015 Trevithick et al.
9,091,125 B2 7/2015 Konduc et al.
9,091,126 B2 7/2015 Thiessen et al.
9,132,871 B2 9/2015 Crisp et al.
9,140,080 B2 9/2015 Flusche
9,151,412 B2 10/2015 Trevithick et al.
9,163,462 B2 10/2015 Donnally et al.
9,212,481 B2 12/2015 Stramandinoli
9,228,394 B2 1/2016 Wijning et al.
9,249,626 B2 2/2016 Flusche
9,260,929 B2 2/2016 Mark
9,267,328 B2 2/2016 Flusche
9,309,728 B2 4/2016 Reddy et al.
9,291,012 B2 5/2016 Wells, Sr.
9,334,668 B2 5/2016 Wijning et al.
9,353,601 B2 5/2016 Hause
9,382,766 B2 7/2016 Flusche
9,399,890 B2 7/2016 Mark
9,441,423 B2 9/2016 Donnally et al.
9,366,053 B2 10/2016 Thiessen et al.
9,464,488 B2 10/2016 Thiessen
9,562,407 B2 2/2017 Magnuson
9,631,443 B2 4/2017 Folk
9,650,840 B2 5/2017 Cheng et al.
9,677,298 B2 6/2017 Konduc et al.
9,708,861 B2 * 7/2017 Reddy ..... E21B 15/003
9,790,751 B2 10/2017 Reddy et al.
9,810,027 B2 * 11/2017 Reddy ..... E21B 15/003
9,845,813 B2 12/2017 Shimizu et al.
9,926,719 B2 * 3/2018 Reddy ..... E04H 12/345
2003/0172599 A1 * 9/2003 Frink ..... E21B 15/003 52/116
2004/0134666 A1 * 7/2004 Orr ..... E21B 19/002 166/379
2005/0126827 A1 6/2005 Berry
2006/0081379 A1 * 4/2006 Fehres ..... E21B 19/155 166/380
2008/0237170 A1 10/2008 Altman et al.
2009/0000218 A1 1/2009 Lee et al.
2009/0025980 A1 1/2009 Callander et al.
2009/0200856 A1 8/2009 Chehade et al.
2009/0272540 A1 * 11/2009 Rodgers ..... E21B 15/003 166/377
2011/0072737 A1 3/2011 Wasterval
2012/0304553 A1 12/2012 Konduc et al.
2013/0305632 A1 11/2013 Rivera, Sr. et al.
2014/0224543 A1 8/2014 Padira et al.
2015/0143759 A1 5/2015 Sparkman et al.
2016/0298394 A1 * 10/2016 Padira ..... E21B 15/003
2016/0376808 A1 * 12/2016 Magnuson ..... E21B 19/12 52/123.1
2017/0106925 A1 4/2017 Gupta et al.
2017/0292334 A1 * 10/2017 Reddy ..... E21B 15/003

FOREIGN PATENT DOCUMENTS

CN 201778661 U 3/2011
DE 849533 C 9/1952

(56) References Cited

FOREIGN PATENT DOCUMENTS

| | | | |
|---|---|---|---|
| EP | 2751370 | B1 | 7/2014 |
| FR | 2556042 | A1 | 6/1985 |
| WO | 2016025521 | A2 | 2/2016 |
| WO | 2016048458 | A1 | 3/2016 |

OTHER PUBLICATIONS

Nabors 990 Proyecto LLANOS.WMV; https://www.youtube.com/watch?v=6BgfgWumRIU, Nabors Rig 990 Chichimene, Colombia; Youtube.com; Aug. 10, 2011 (231 pages).

Drilling Contractor; "Nabors modular Rig 702 in Papua New Guinea-bound for ExxonMobil"; Drilling Contractor, in Drilling Rigs & Automation, News, Jul. 6, 2011; 2 pages; www.drillingcontractor.org.

Drilling Contractor; "Nabors to base all future land rigs on Minimum Area AC rig concept"; Drilling Contractor, in News, Aug. 22, 2011; 2 pages; www.drillingcontractor.org.

Sebastion, Simone; "Big drill soon begins long commute to work"; Houston Chronicle, Sunday, Jul. 3, 2011; 3 pages; www.chron.com.

Gaddy, Dean E., "Critical path analysis improves rig-moving procedures", Oil & Gas Journal, Nov. 16, 1998 (5 pages).

* cited by examiner

SIDE SADDLE SUBSTRUCTURE

CROSS-REFERENCE TO RELATED APPLICATIONS

This application is a continuation of U.S. Pat. No. 9,810,027, filed Feb. 13, 2014, which is itself a non-provisional application which claims priority from U.S. provisional application No. 61/764,259 filed Feb. 13, 2013.

FIELD OF THE DISCLOSURE

The present disclosure relates generally to drilling rigs, and specifically to box-on-box rig structures for land drilling in the petroleum exploration and production industry.

BACKGROUND OF THE DISCLOSURE

Land-based drilling rigs may be configured to be skidded from location to location to drill multiple wells within the same area known as a wellsite. In certain situations, it is necessary to skid across an already drilled well for which there is a well-head in place. Further, mast placement on land-drilling rigs may have an effect on drilling activity. For example, depending on mast placement on the drilling rig, an existing well-head may interfere with the location of land-situated equipment such as, for instance, existing well-heads, and may also interfere with raising and lowering of equipment needed for operations.

SUMMARY

The present disclosure provides for a drilling rig. The drilling rig may include a first substructure; a second substructure, the second substructure being positioned generally parallel to and spaced apart from the first substructure and being generally the same height as the first substructure; and a drill floor coupled to the first and second substructures, the drill floor positioned substantially at the top of the first and second substructures.

The present disclosure also provides for a substructure for use in a drilling rig. The substructure may include a substructure frame, the substructure frame configured to at least partially support a drilling floor; and a tank support structure affixed to the substructure.

The present disclosure also provides for a drilling rig. The drilling rig may include a first substructure; a second substructure, the second substructure being positioned generally parallel to and spaced apart from the first substructure and being generally the same height as the first substructure; and a drill floor coupled to the first and second substructures. The drill floor may be positioned substantially at the top of the first and second substructures. The drill floor may include a V-door, the V-door generally aligned with a side of the drill floor, and the side of the drill floor with which the V-door is aligned may face towards the first or second substructure. The drilling rig may also include a mast coupled to the drill floor. The drilling rig may also include a tank support structure affixed to the first or second substructure. The tank support structure may include a tank and mud process equipment. The drilling rig may also include a grasshopper positioned to carry cabling and lines to the drilling rig. The grasshopper may be positioned to couple to the drill floor generally at a side of the drill floor, and the side of the drill floor to which the grasshopper couples may face towards the first or second substructure.

BRIEF DESCRIPTION OF THE DRAWINGS

The summary and the detailed description are further understood when read in conjunction with the appended drawings. For the purpose of illustrating the present disclosure, there are shown in the drawings exemplary embodiments of said disclosure; however, the disclosure is not limited to the specific methods, compositions, and devices disclosed. In addition, the drawings are not necessarily drawn to scale. In the drawings.

DETAILED DESCRIPTION

The present disclosure may be understood more readily by reference to the following detailed description, taken in connection with the accompanying figures, which form a part of this disclosure. It is to be understood that this disclosure is not limited to the specific devices, methods, applications, conditions or parameters described and/or shown herein, and that the terminology used herein is for the purpose of describing particular embodiments by way of example only and is not intended to be limiting of the present disclosure. Also, as used in the specification, including the appended claims, the singular forms "a," "an," and "the" include the plural, and reference to a particular numerical value includes at least that particular value, unless the context clearly dictates otherwise. The term "plurality," as used herein, means more than one.

Figure 1:
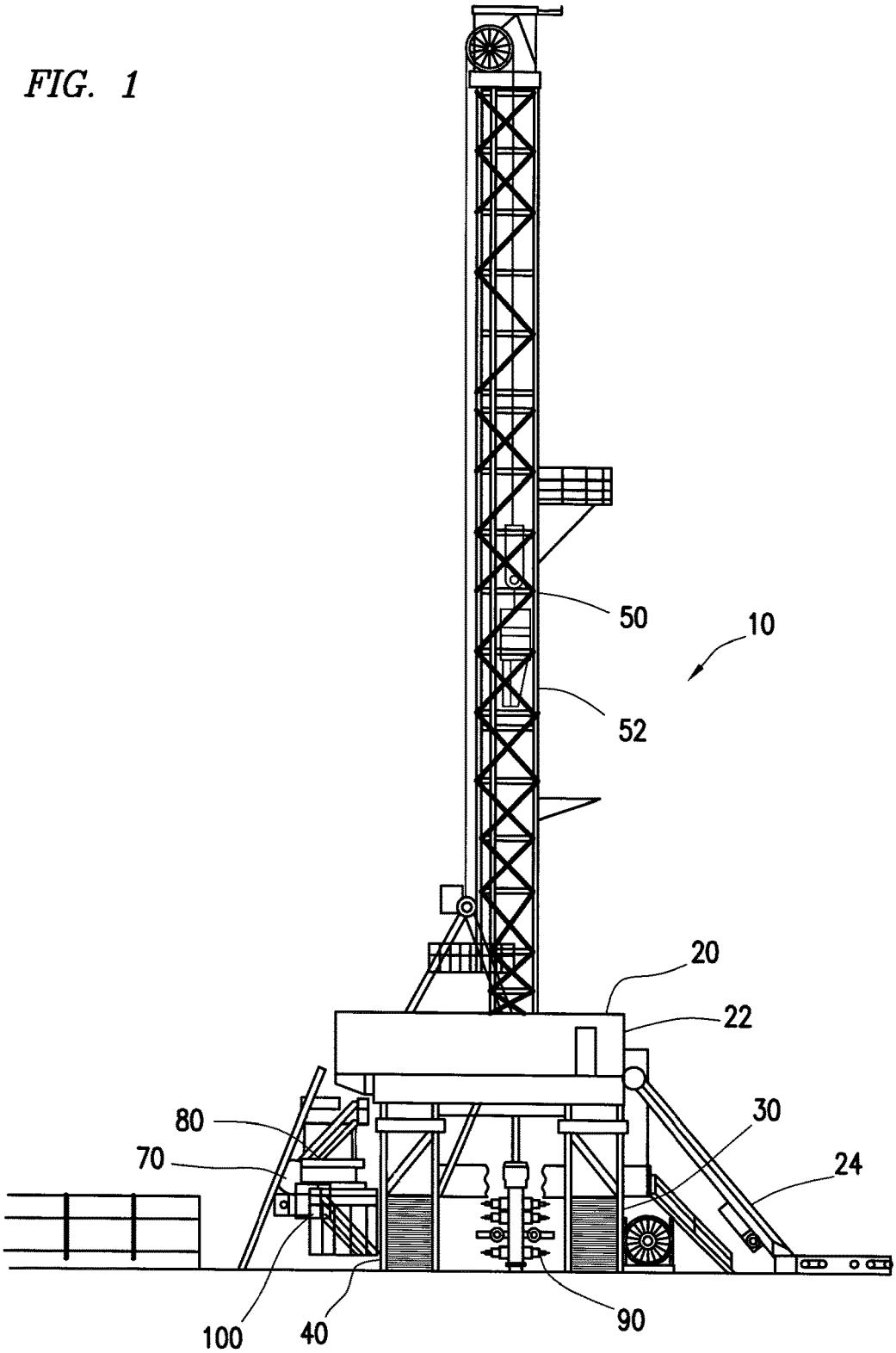
FIG. 1 is a side elevation from the driller's side of a drilling rig consistent with at least one embodiment of the present disclosure.

FIG. 1 depicts a side elevation of drilling rig 10 from the "driller's side" consistent with at least one embodiment of the present disclosure. Drilling rig 10 may include drill rig floor 20, right substructure 30, and left substructure 40. Right and left substructures 30, 40 may support drill rig floor 20. Mast 50 may be coupled to drill rig floor 20. As would be understood by one having ordinary skill in the art with the benefit of this disclosure, the terms "right" and "left" as used herein are used only to refer to each separate substructure to simplify discussion, and are not intended to limit this disclosure in any way. V-door side 22 of drilling rig 10 may be located over right substructure 30. The V-door side 52 of mast 50 may correspondingly face right substructure 30. Pipe handler 24 may be positioned to carry piping through a V-door as understood in the art positioned on V-door side 22 of drilling rig 10. In some embodiments, grasshopper (not shown) may be positioned to carry cabling and lines to drilling rig 10. In other embodiments (not shown), V-door side 22 and mast V-door side may face left substructure 40. In some embodiments, as depicted in FIG. 1, blow out preventer 90 may be located between left substructure 40 and right substructure 30, i.e. drilling rig 10 may be centered over a wellbore.

In some embodiments, tank support structure 80 and tanks 70 may be included in drilling rig 10. Tank support structure 80 may be affixed to right substructure 30 or left substructure 40 by means known to those of ordinary skill in the art with the benefit of this disclosure, including, but not limited to, welding and bolting. As shown in FIG. 1, tank support structure 80 may be affixed to left substructure 40. Tank support structure 80 may be located on the opposite substructure from V-door side 22 of drilling rig 10. Tanks 70 may, for example, be mud tanks, auxiliary mud tanks, or other tanks useful in drilling operations and may be located within tank support structure 80. In some embodiments, mud process equipment 100 may also be mounted within tank support structure 80. Mud process equipment may include, for example, shakers, filters, and other equipment associated with the use of drilling mud.

Figure 2:
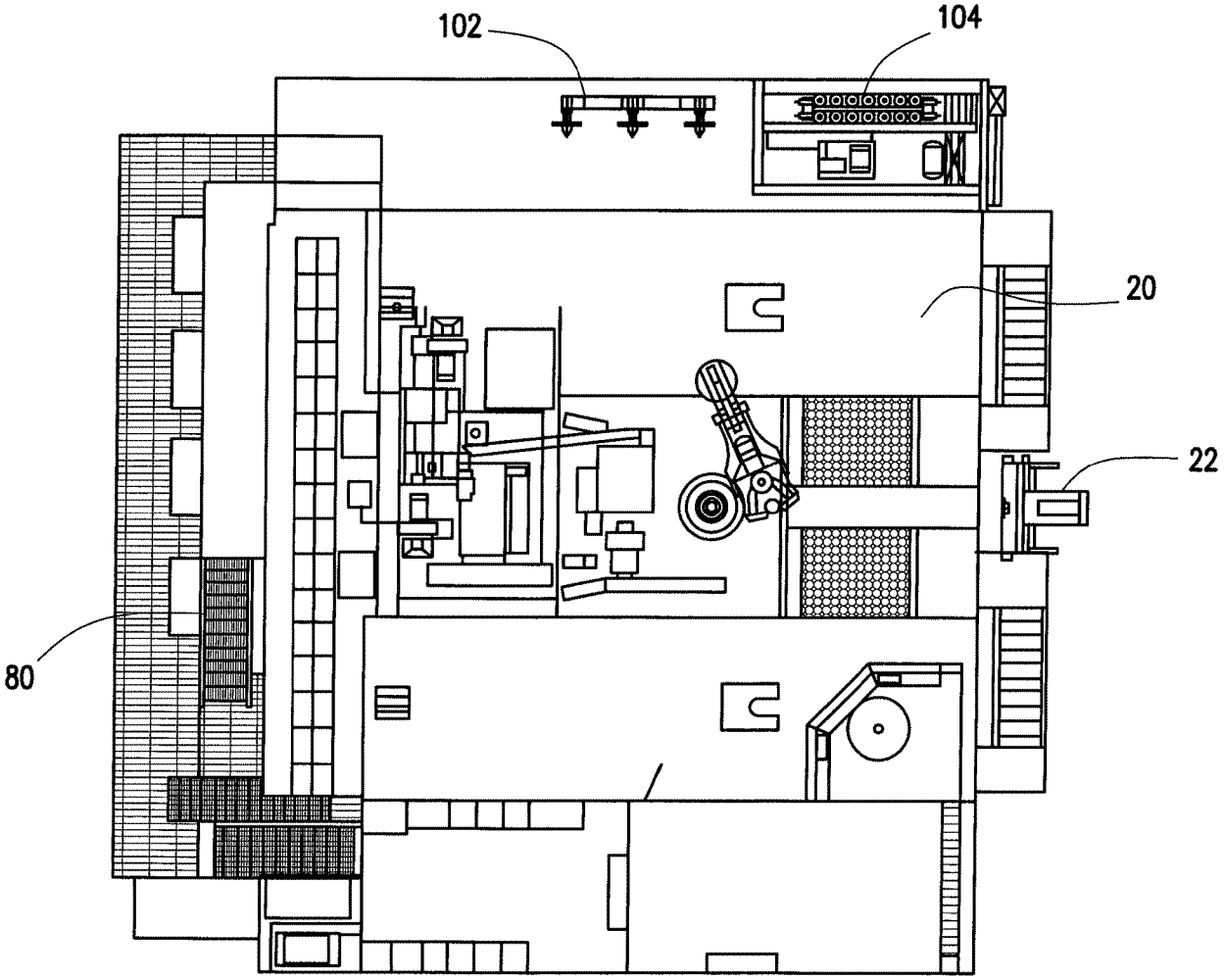
FIG. 2 is an overhead view of a drilling rig consistent with at least one embodiment of the present disclosure.

FIG. 2 depicts an overhead view of drilling rig 10 consistent with at least one embodiment of the present disclosure in which V-door side 22 of drilling rig 10, drilling rig floor 20, and tank support structure 80 are shown. In some embodiments, choke manifold 102 may likewise be located on the rig floor. In some embodiments, accumulator 104 may likewise be located on the rig floor.

As they are mounted directly to a substructure (30 or 40) of drilling rig 10, tanks 70, mud process equipment 100, choke manifold 102, and accumulator 104 may travel with drilling rig 10 during a skidding operation. As such any pipe or tubing connections between or taken from tanks 70, mud process equipment 100, choke manifold 102, and/or accumulator 104 may remain connected during the skidding operations. This arrangement may allow, for example, more rapid rig disassembly ("rigging-down") and assembly (or "rigging-up") of drilling rig 10 before and after a skidding operation.

Additionally, by facing V-door side 22 of drilling rig 10 toward one of the substructures 30, 40, equipment and structures that pass through the V-door or to drilling floor 20 from V-door side 22 of drilling rig 10 may, for example, be less likely to interfere with additional wells in the well field.

One having ordinary skill in the art with the benefit of this disclosure will understand that the specific configuration depicted in FIGS. 1, 2 may be varied without deviating from the scope of this disclosure.

Those skilled in the art will appreciate that numerous changes and modifications can be made to the preferred embodiments of the present disclosure and that such changes and modifications can be made without departing from the spirit of said disclosure. It is, therefore, intended that the appended claims cover all such equivalent variations as fall within the true spirit and scope of said disclosure.

What is claimed is:

1. A land based, box-on-box drilling rig comprising:

a first elongated substructure;

a second elongated substructure, the second elongated substructure being positioned generally parallel to and spaced apart from the first sub structure;

a drill rig floor fixedly coupled to the first and second substructures, the drill rig floor positioned substantially at the top of the first and second elongated substructures; and a mast, the mast coupled to the drill rig floor;

wherein the box-on-box, land based drilling rig is adapted to be travelled in an assembled state through a wellsite.

2. The drilling rig of claim 1, wherein the mast further comprises a V-door side and wherein the V-door side of the mast faces the first or second elongated sub structure.

3. The drilling rig of claim 1, further comprising a blowout preventer, the blowout preventer located between the first and second elongated substructures.

4. The drilling rig of claim 1, wherein the drilling rig is centered over a wellbore.

5. The drilling rig of claim 1, wherein the second elongated substructure is generally the same height as the first substructure.

6. The drilling rig of claim 1, further comprising a tank support substructure coupled to the first or second elongated substructure.

7. The drilling rig of claim 6, wherein the tank support substructure further comprises a tank.

8. The drilling rig of claim 7, wherein the tank is a mud tank.

9. The drilling rig of claim 6, wherein the tank support substructure further comprises mud process equipment.

10. The drilling rig of claim 9, wherein the mud process equipment comprises at least one of a shaker or a filter.

11. The drilling rig of claim 6, wherein the tank support structure remains coupled to the first or second elongated substructure when the first and second elongated substructures are traveled.

12. The drilling rig of claim 1, wherein the drill rig floor further comprises a V-door, the V-door generally aligned with a side of the drill rig floor defining a V-door side, and the side of the drill rig floor with which the V-door is aligned facing towards the first or second elongated substructure.

13. The drilling rig of claim 12, further comprising a pipe handler, the pipe handler positioned to carry piping through the V-door.

14. The drilling rig of claim 12, further comprising a tank support structure, the tank support structure coupled to the second elongated substructure and wherein the V-door side is aligned facing towards the first elongated substructure.

15. The drilling rig of claim 1, further comprising a choke manifold.

16. The drilling rig of claim 15, wherein the choke manifold is positioned on the drill rig floor.

17. The drilling rig of claim 15, wherein the choke manifold is coupled to one of the first or second elongated substructures.

18. The drilling rig of claim 17, wherein the choke manifold remains coupled to the first or second elongated substructure when the first and second elongated substructures are traveled.

19. The drilling rig of claim 1, further comprising an accumulator.

20. The drilling rig of claim 19, wherein the accumulator is positioned on the drill rig floor.

21. The drilling rig of claim 19, wherein the accumulator is coupled to one of the first or second elongated substructures.

22. The drilling rig of claim 20, wherein the accumulator remains coupled to the first or second elongated substructure when the first and second substructures are traveled.

23. A substructure for use in a land-based, box-on-box drilling rig, the substructure comprising:

a substructure frame, the substructure frame configured to at least partially support a drill rig floor, the drill rig floor fixedly coupled to the substructure frame; and a tank support structure coupled to the substructure, wherein the tank support structure further comprises a tank;

wherein the box-on-box land based drilling rig is adapted to be travelled in an assembled state through a wellsite.

24. The substructure of claim 23, wherein the tank comprises a mud tank.

25. The substructure of claim 23, wherein the tank support substructure further comprises mud process equipment.

26. The substructure of claim 25, wherein the mud process equipment comprises at least one of a shaker or a filter.

27. The substructure of claim 23, further comprising a choke manifold coupled to the substructure.

28. The substructure of claim 23, further comprising an accumulator coupled to the substructure.

29. A box-on-box, land-based drilling rig comprising:

a first substructure;

a second substructure, the second substructure being positioned generally parallel to and spaced apart from the first substructure and being generally the same height as the first substructure;

a drill rig floor fixedly coupled to the first and second substructures, the drill rig floor positioned substantially at the top of the first and second substructures, the drill rig floor including a V-door, the V-door generally aligned with a side of the drill rig floor, and the side of the drill rig floor with which the V-door is aligned faces towards the first or second substructure;

a mast coupled to the drill rig floor;

a tank support structure affixed to the first or second substructure, the tank support structure including:

a tank; and mud process equipment;

wherein the box-on-box, land based drilling rig is adapted to be travelled in an assembled state through a wellsite.

* * * * *